US005906159A

United States Patent [19]

Mori et al.

[11] Patent Number: 5,906,159

[45] Date of Patent: May 25, 1999

[54] STENCIL INK HOLDING MEMBER MADE OF SINTERED FIBERS

[75] Inventors: Tomiya Mori, Kakuda; Kazuto Yaegashi, Iwanuma, both of Japan

[73] Assignee: Tohoku Ricoh Co., Ltd., Miyagi-ken, Japan

[21] Appl. No.: 08/796,528

[22] Filed: Feb. 7, 1997

[30] Foreign Application Priority Data

Mar. 26, 1996 [JP] Japan ..... 8-070301

[51] Int. Cl.[6] ..... B41N 1/24

[52] U.S. Cl. ..... 101/128.21; 101/116; 101/127

[58] Field of Search ..... 101/114, 116, 101/127, 128.21, 128.4, 129

[56] References Cited

U.S. PATENT DOCUMENTS

| | | | |
|---|---|---|---|
| 2,997,777 | 8/1961 | Davies | 428/566 |
| 3,923,936 | 12/1975 | Davis et al. | 101/128.4 |
| 4,526,098 | 7/1985 | Bachman | 101/128.4 |
| 4,911,069 | 3/1990 | Hayama et al. | 101/120 |
| 5,181,549 | 1/1993 | Shapovalov | 164/79 |
| 5,215,724 | 6/1993 | Haerle | 422/180 |
| 5,662,040 | 9/1997 | Mori et al. | 101/128.4 |

FOREIGN PATENT DOCUMENTS

| | | | |
|---|---|---|---|
| 0 127 192 | 12/1984 | European Pat. Off. . | |
| 59-229 | 1/1984 | Japan . | |
| 59-164188 | 9/1984 | Japan | 101/128.4 |
| 59-218889 | 12/1984 | Japan . | |
| 61-169294 | 7/1986 | Japan | 101/128.21 |
| 63-59393 | 11/1988 | Japan . | |
| 1-204781 | 8/1989 | Japan . | |
| 1-267094 | 10/1989 | Japan . | |
| 5-41026 | 10/1993 | Japan . | |
| 7-258706 | 10/1995 | Japan . | |
| 741680 | 6/1976 | Netherlands | 101/128.21 |

*Primary Examiner*—Stephen R. Funk
*Attorney, Agent, or Firm*—Oblon, Spivak, McClelland, Maier & Neustadt, P.C.

[57] ABSTRACT

A drum and an ink holding member for a stencil printer and capable of obviating offset effectively, and a stencil highly resistive to printing are disclosed. The ink holding member constitutes the outer periphery of the drum and allows the stencil or master to be wrapped therearound. The ink holding member is implemented as a sintered sheet of fibers. At least the surfaces of the fibers are constituted by metal.

8 Claims, 11 Drawing Sheets

STENCIL INK HOLDING MEMBER MADE OF SINTERED FIBERS

BACKGROUND OF THE INVENTION

The present invention relates to a stencil for use in a stencil printer, and a drum and an ink holding member for the stencil printer.

A digital stencil printer using a thermosensitive stencil i s extensively used as a simple and convenient printer. Usually, the thermosensitive stencil has a laminate structure comprising an about 40 μm to 50 μm thick porous substrate and a thermoplastic resin film as thin as about 1 μm to 2 μm and adhered to the substrate. The porous substrate is implemented by Japanese paper fibers, synthetic fibers or a mixture thereof. There has recently been proposed a stencil consisting only of a thermoplastic resin film. The stencil printer includes a rotatable drum having a porous hollow cylinder and an ink holding layer covering the outer periphery of the cylinder. The ink holding layer is constituted by a mesh screen of resin fibers or metal fibers. The thermoplastic resin film has its surface perforated by heat in accordance with image data so as to turn out a master. After the master has been wrapped around the drum, ink is fed to the drum by ink feeding means disposed in the drum. A press roller or similar pressing means continuously presses a sheet against the drum. As a result, the ink oozes out from perforations formed in the master via pores formed in the drum, forming an image on the sheet.

A problem with the stencil printer is that when the printer is operated after being left unaerated over a certain period of time or after a stop of printing, defective printing is apt to occur due to the evaporation of the ink. To solve this problem, it has been customary to use oil ink or water-in-oil emulsion ink which evaporates little. However, because this kind of ink does not dry rapidly, a certain period of time is necessary for the ink to infiltrate into the sheet and dry to such a degree that it does not smear the sheet when rubbed by a finger or the like.

In the stencil printer, sheets carrying images thereon, i.e., printings are sequentially stacked on a tray. If a printing is immediately laid on a printing existing on the tray, the ink on the front of the former deposits on the rear of the latter and smears it. This kind of smearing, or so-called offset, occurs frequently when the amount of ink, particularly the thickness (or height) of ink, forming an image on a sheet is great.

Further, the drum or the master wrapped therearound does not allow the ink to cut or stop sharply. During printing, adhesion acts between the ink on the surface of the master and a sheet when the sheet is separated form the surface of the drum. At this instant, the ink is filled in bores formed in an ink holding member (or porous substrate) and bores formed in a porous support included in the drum. The above adhesion acting between the ink and the sheet causes the ink to be drawn out via perforations formed in the master. As a result, the ink is transferred to the sheet in an excessive amount. It is therefore almost impossible to reduce the amount of the ink to be transferred to the sheet so as to obviate offset.

In light of the above, there has been proposed an ink holding member (or porous substrate) in the form of a mesh screen whose bores are reduced in size. With this configuration, it is possible to reduce the amount of the ink to be drawn out. However, this cannot be done unless the mesh screen (or Japanese paper) constituting the ink holding member (or porous substrate) is #1,000 to #3,000 in terms of mesh size. This kind of mesh screen results in a disproportionately expensive ink holding member (or porous substrate).

Furthermore, the conventional ink holding member or porous substrate includes many portions where the ink flows out straight, i.e., with high fluidity. In such portions, the ink flows out in a great amount and causes offset to occur. In addition, the conventional porous substrate is low in tensile strength, oil resistance and water resistance and apt to extend or break during printing. This limits resistivity to printing available with the stencil.

Conventional technologies relating to the present invention are disclosed in, e.g., Japanese Patent Laid-Open Publication Nos. 7-258706, 1-204781 (corresponding U.S. Pat. No. 4,911,069), 59-218889, 1-267094, and 57-51485 (corresponding Japanese Patent Publication No. 63-59393), Japanese Utility Model Publication Nos. 5-41026 and 59-229, and European Publication No. 0 127 192.

SUMMARY OF THE INVENTION

It is therefore an object of the present invention to provide a drum and an ink holding member for a stencil printer capable of obviating offset effectively, and a stencil for the stencil printer which is highly resistive to printing.

In accordance with the present invention, a stencil for a stencil printer has a thermoplastic resin film, and a porous substrate adhered to the thermoplastic resin film. The porous substrate is a sintered sheet of fibers. At least the surfaces of the fibers are constituted by metal.

Also, in accordance with the present invention, in a drum included in a stencil printer, and having an ink holding member on the outer periphery thereof, and allowing a master to be wrapped therearound, the ink holding member is a sintered sheet of fibers. At least the surfaces of the fibers are constituted by metal.

Further, in accordance with the present invention, in an ink holding member constituting the outer surface of a drum included in a stencil printer, and implemented by a sintered sheet of fibers, at least the surfaces of the fibers are constituted by metal.

BRIEF DESCRIPTION OF THE DRAWINGS

The above and other objects, features and advantages of the present invention will become apparent from the following detailed description taken with the accompanying drawings in which.

In the drawings, identical reference numerals denote identical structural elements.

DESCRIPTION OF THE PREFERRED EMBODIMENTS

Figure 1:
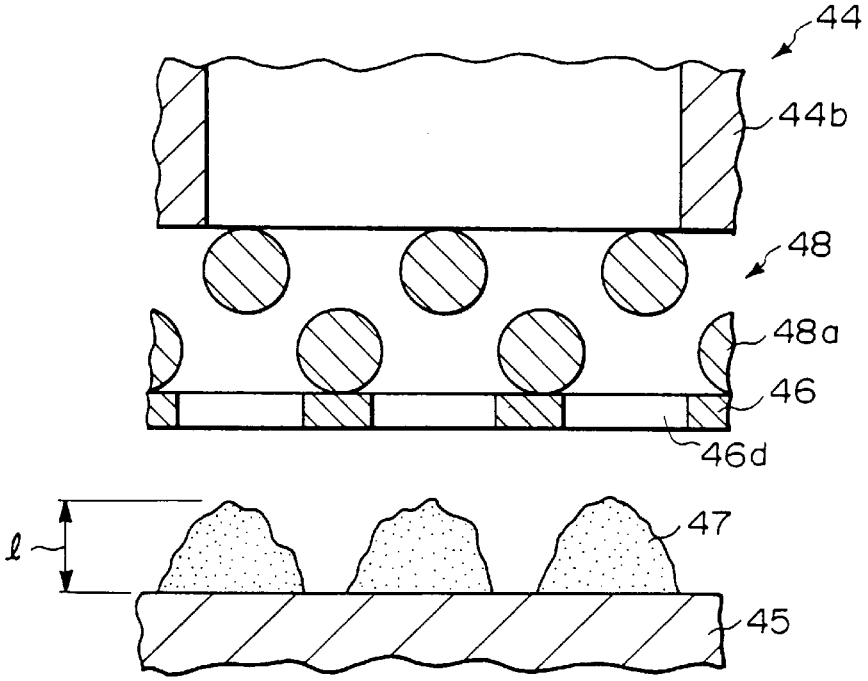
Fig. 1 PRIOR ART
FIGS. 1 and 2 each shows a particular condition in which ink is transferred to a sheet in a conventional stencil printer.

To better understand the present invention, the problems with the conventional stencil printer will be described specifically. One of the problems is that a drum or a master wrapped therearound does not allow ink to cut sharply, as discussed earlier. As shown in FIG. 1, during printing, adhesion acts between ink on the surface of a master 46 and a sheet 45 when the sheet 45 is separated form the surface of a drum 44. At this instant, ink 47 is filled in bores formed in an ink holding member 48 (or porous substrate) and bores formed in a porous support 44*b* included in the drum 44. The ink holding member 48 is constituted by fibers 48*a*, as illustrated. The above adhesion acting between the ink 47 and the sheet 45 causes the ink 47 to be drawn out via perforations 46*d* formed in a stencil or master 46. As a result, the ink is transferred to the sheet 45 in an excessive amount. It is therefore almost impossible to reduce the amount of the ink 47 to be transferred to the sheet 45 so as to obviate offset.

The amount of the ink 47 to be drawn out, as stated above, is related to the structure of the ink holding member 48 (or porous substrate). Assume that the bores formed in the ink holding member 48 are great and form broad ink passages, i.e., promote the flow of the ink 47. Then, as shown in FIG. 1, it becomes more difficult for the ink to cut sharply in the member 48 as the size of the above bores increases. As a result, the ink 47 is drawn out in a greater amount from the member 48 via the perforations 46*d* of the master 46, as represented by a height l on the sheet 45.

Figure 2:
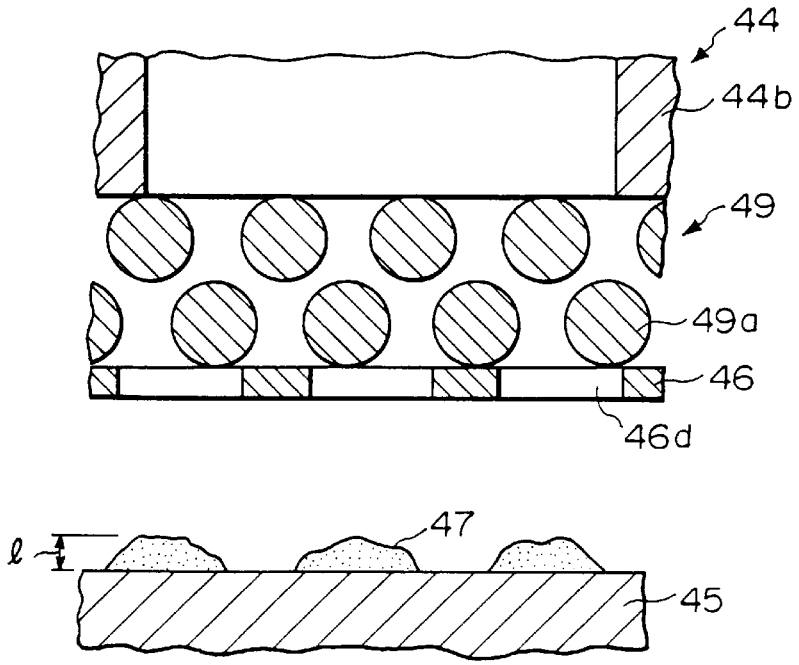
Fig. 2 PRIOR ART

In light of the above, as shown in FIG. 2, there has been proposed an ink holding member 49 (or porous substrate) in which adjacent fibers 49*a* are spaced by small gaps. With this configuration, it is possible to reduce the amount of the ink 47 to be drawn out, i.e., the height l. In addition, many fibers 49*a* are present above the perforations 46*d* of the master 46, reducing, in effect, the size of the perforations 46*d*. This further limits the amount of the ink 47 to be drawn out via the master 46.

However, the ink holding member 48 (or porous substrate) is implemented as a mesh screen (or Japanese paper) having gaps or bores sized #100 to #360 in terms of mesh size. Such bores are too great to prevent the ink from being drawn out from the member 48. Further, to make the bores as small as the bores of the ink holding member 49 shown in FIG. 2, there must be used a mesh screen (or Japanese paper) of #1,000 to #3,000 in terms of mesh size. This kind of mesh screen results in a disproportionately expensive ink holding member (or porous substrate).

Figure 3:
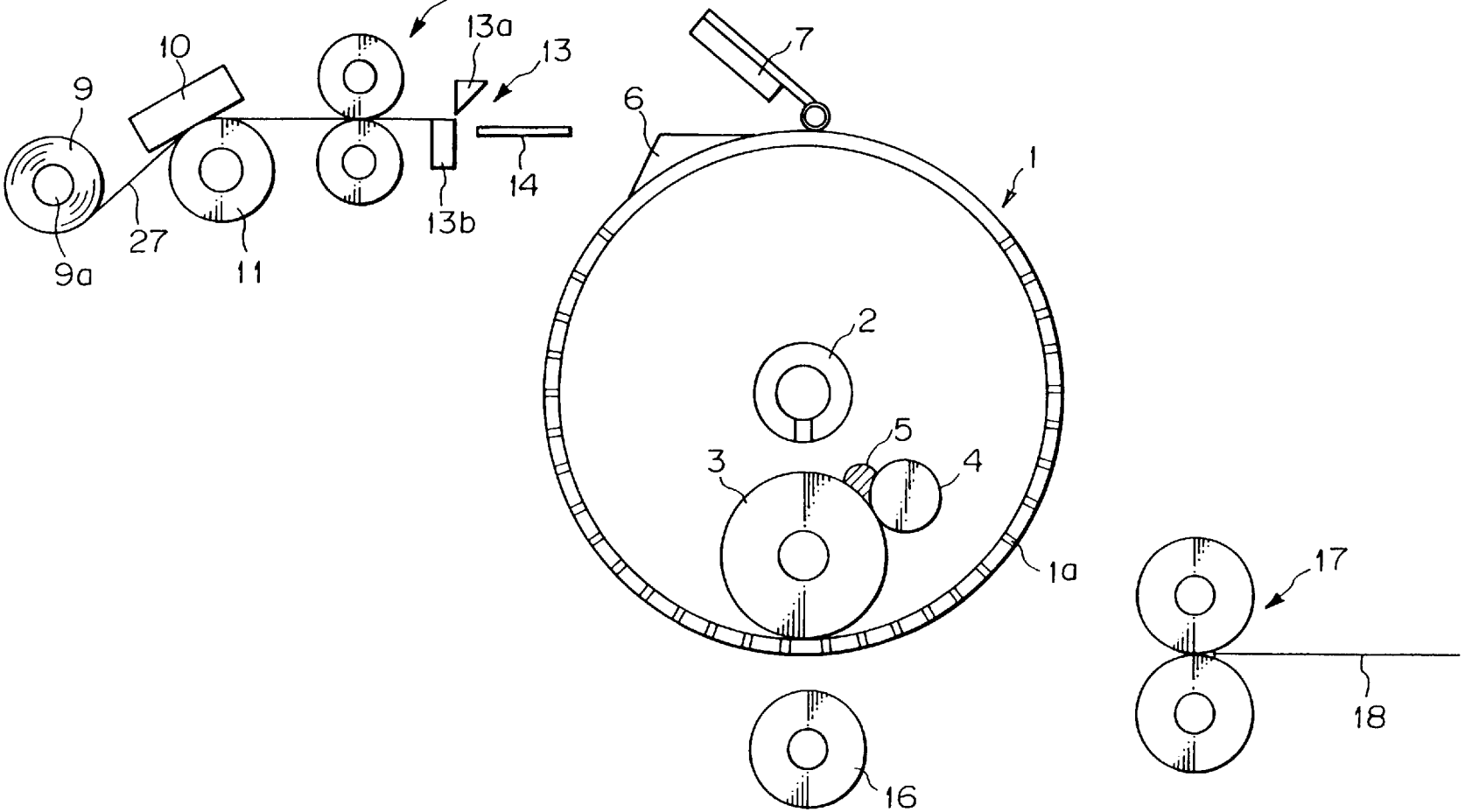
FIG. 3 is a side elevation showing the essential part of a first embodiment of the stencil printer in accordance with the present invention.

Referring to FIG. 3, a first embodiment of the stencil printer in accordance with the present invention will be described. As shown, the printer includes a drum 1 to be driven by drum drive means, not shown. An ink pipe 2, an ink roller 3, a doctor roller 4 and so forth constituting ink feeding means are disposed in the drum 1.

Figure 4:
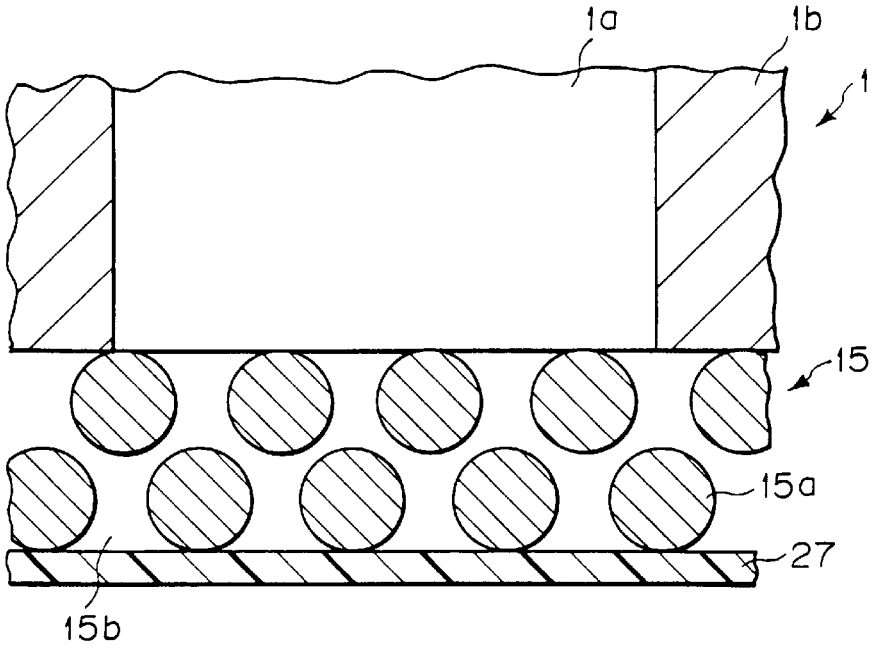
FIG. 4 is a fragmentary sectional side elevation showing a drum and an ink holding member included in the first embodiment.

As shown in FIG. 4, the drum 1 is made up of a porous support 1*b* having pores 1*a* (only one is shown), and an ink holding member 15 in the form of a sheet covering the support 1*b*. In the illustrative embodiment, the ink holding member or sheet 15 is formed by sintering a high-density unwoven cloth having fibers 15*a* formed of stainless steel, iron, copper, nickel, titanium, aluminum or similar metal. To sinter unwoven cloth means to melt the intersecting portions of its fibers by heat so as to connect them together. The ink holding member 15 has ink passages and serves to scatter, hold and force out ink while regulating the outflow of the ink.

A procedure for producing the ink holding member or sintered sheet 15 and disclosed in previously mentioned Japanese Patent Laid-Open Publication No. 7-258706 will be described. First, slurry is prepared in which metal fibers separate from each other are dispersed in, e.g., water. The slurry is fed onto a porous, flexible ceramic sheet which plays the role of a separator. Then, the ceramic sheet with the slurry is dehydrated by a wet-process paper scheme with the result that a metal fiber sheet (unwoven cloth) is formed on the separator. Subsequently, another separator in the form of a porous, flexible ceramic sheet is laid on the metal fiber sheet. As a result, a three-layer sheet having two separators sandwiching the metal fiber sheet is produced. The separators are mesh sheets having fibers knit in a mesh configuration. For the separators, use may be made of, e.g., alumina sheets or zirconia sheets. The three-layer sheet is pressed for dehydration, dried by heat, and then subjected to heat treatment at a temperature lower than the melting point of the metal fibers. As a result, the intersecting portions of the metal fibers are connected together, completing a sintered sheet. For the above heat treatment, use is made of a vacuum sintering furnace or of a continuous sintering furnace with an argon gas or hydrogen gas atmosphere (soldering furnace with a mesh belt).

After the upper and lower separators have been separated from the sintered sheet, the sheet is subjected to calender processing in order to adjust its density, thickness and smoothness.

A stencil 8 which will be described includes a porous substrate 8*c* implemented as a sintered sheet of unwoven cloth of metal fibers 8*a*. The above procedure for making a sintered sheet is also applied to the porous substrate 8*c*.

If desired, fine powder of, e.g., metal may be dispersed in the sintered sheet and then deposited or adhered in order to reduce bores or gaps between the metal fibers.

Referring again to FIG. 3, the ink pipe 2 bifunctions as a shaft on which the drum 1 is mounted. The ink pipe 2 is affixed to opposite side walls of a casing, not shown, and formed with a plurality of small holes for feeding ink into the drum 1. A pump, not shown, pumps ink from an ink pack, not shown, located outside of the drum 1 and feeds the ink under pressure to the inside of the drum 1 via the ink pipe 2. The ink roller 3 and doctor roller 4 are positioned below the ink pipe 2. The ink roller 3 is journalled to opposite side walls disposed in the drum 1. The outer periphery of the ink roller 3 adjoins the inner periphery of the drum 1, so that the ink fed via the ink pipe 2 is transferred to the drum 1 by way of the roller 3. The output torque of the drum drive means is also transmitted to the ink roller 3 by gears, belt or similar drive transmission means. The ink roller 3 is therefore rotatable clockwise, as viewed in FIG. 3, in synchronism with the drum 1.

The doctor roller 4 is freely rotatable in the vicinity of the ink roller 3. The outer periphery of the doctor roller 4 and that of the ink roller 3 are spaced by a small gap in order to form a wedge-like ink well 5 therebetween. The ink fed from the ink pipe 2 to the ink well 5 is passed through the gap between the rollers 3 and 4 and then deposited on the roller 3 in the form of a uniform layer.

A stage 6 is mounted on a part of the outer periphery of the drum 1 where the pores 1*a*, FIG. 4, are absent. The stage 6 extends in the axial direction of the drum 1. A damper 7 is hinged to the stage 6 and provided with a magnet. Opening/closing means, not shown, causes the damper 7 to move toward or away from the stage 6, as needed.

A stencil 27 in the form of a roll 9 is positioned above and at the left-hand side of the drum 1, as viewed in FIG. 3. The stencil 27 consists only of a thermoplastic resin film. A thermal head 10 having a number of heating elements, a platen roller 11 cooperative with the head 10, a conveyor roller pair 12, cutting means 13 and a guide plate 14 are also positioned above the drum 1. The roll 9 has a core 9*a* rotatably supported by holder means, not shown.

Specifically, the thermal head 10 and platen roller 11 are supported by opposite side walls, not shown, included in the printer. Biasing means, not shown, constantly biases the head 10 toward the platen roller 11 which is freely rotatable. Stepping motor, not shown, causes the platen roller 11 to rotate clockwise, as viewed in FIG. 3. While the platen roller 11 presses the stencil or film 27 against the head 10, the head 10 cuts or perforates the stencil 27 by heat. At the same time, the platen roller 11 in rotation pays out the stencil 27 from the roll 9.

The conveyor roller pair 12 is positioned downstream of the head 10 and platen roller 11 with respect to the direction in which the stencil 27 is conveyed. The roller pair 12 rotatably supported by the side walls of the printer is rotated by drive means, not shown, at a slightly higher peripheral speed than the platen roller 11. A torque limiter, not shown, is mounted on the roller pair 12. In this condition, a preselected degree of tension constantly acts on the stencil 27 between the platen roller 11 and the roller pair 12.

The cutting means 13 and guide plate 14 are located downstream of the roller pair 12 in the direction of stencil conveyance. The cutting means 13 consists of a movable edge 13*a* and a stationary edge 13*b*. The movable edge 13*a* is rotatable or movable up and down relative to the stationary edge 13*b* in order to cut off the perforated part of the stencil, i.e., master 27, as conventional. The guide plate 14 is affixed to the side walls of the printer in order to guide the master 27 being conveyed.

A press roller or pressing means 16 is positioned below the drum 1 and rotatably supported. Moving means, not shown, selectively moves the press roller 16 to a position where the roller 16 does not contact the drum 1 or a position where the former contacts the latter. A registration roller pair 17 is located at the right-hand side of the press roller 16. A sheet 18 is fed toward the registration roller pair 17 by sheet feeding means, not shown. The roller pair 17 nips the leading edge of the sheet 18 and then drives the sheet 18 to between the drum 1 and the press roller 16 when the roller 16 contacts the drum 1. The press roller 16 may be replaced with a press drum substantially identical in diameter with the drum 1, if desired.

The printer having the above construction is operated as follows. Assume that the operator sets a document on a document reading section, not shown, and then presses a perforation start key, not shown. Then, the drum 1 starts rotating. A master discharging device, not shown, peels off a used master wrapped around the drum 1 and discharges it. As soon as the damper 7 reaches substantially the top of the drum 1, the drum 1 stops rotating and waits for a perforated stencil or master. In this condition, the opening/closing means moves the damper 7 away from the stage 6, as shown in FIG. 3.

The discharge of the used master is followed by a master making operation. Specifically, an image read out of the document is transformed to an electric signal by, e.g., a CCD (Charge Coupled Device) image sensor included in the document reading section. The electric signal is sent to a perforation controller via an analog-to-digital converter as image data. The perforation controller selectively feeds current, or pulses, to the heating elements of the thermal head 10 in accordance with the image data. As a result, the head 10 perforates the stencil 27 by heat. Before the operation of the head 10, the platen roller 11 is rotated by the stepping motor in order to pay out the stencil 27 from the roll 9.

The perforated part of the stencil, i.e., master 27 is conveyed toward the damper 7 by the roller pair 12 while being guided by the guide plate 14. When the leading edge of the master 27 arrives at a preselected position between the damper 7 and the stage 6, as determined on the basis of the number of steps of the stepping motor, the opening/closing means moves the damper 7 counterclockwise. After the damper 7 and stage 6 have nipped the leading edge of the master 27, the drum 1 starts rotating clockwise at a peripheral speed substantially the same as the speed at which the stencil is conveyed. As a result, the master 27 begins to be wrapped around the drum 1.

When a single master 27 has been fully perforated, as also determined on the basis of the number of steps of the stepping motor, the platen roller 11 and roller pair 12 are brought to a stop. Then, the cutting means 13 cuts off the master 27 from the stencil or webbing. The master 27 is pulled out by the drum 1 in rotation and wrapped around the drum 1.

After the master 27 has been wrapped around the drum 1, a trial printing is produced by the following procedure. The sheet 18 is nipped by the registration roller pair 17, as stated earlier. At this instant, the drum 1 carrying the master 27 thereon is rotating at a low speed. The registration roller pair 17 drives the sheet 18 to between the drum 1 and the press roller 16 when the image area of the stencil 27 arrives at a position where it faces the press roller 16. The press roller 16 presses the sheet 18 against the master 27 wrapped around the drum 1. As a result, the ink fed to the inner periphery of the drum 1 by the ink roller 3 oozes out into the pores 1*a* and the open areas of the ink holding member 15.

The ink filled in the open areas of the member 15 is transferred to the sheet 18 via the perforations of the master 27, reproducing the document image on the sheet 18.

The sheet 18 with the document image is separated from the drum 1 by a separator, not shown, and then driven out of the printer by discharging means, not shown, as a trial printing.

After the trial printing has been produced, the operator presses a print start key, not shown. In response, sheets 18 are sequentially fed to between the drum 1 and the press roller 16 by the sheet feeding means while the drum 1 is rotated at a high speed. Consequently, printings each carrying the document image are sequentially produced.

During the trial printing or the actual printing, when the sheet 18 is separated from the drum 1, a force tending to draw ink 19 (see FIG. 5) out of the ink holding member 15 via perforations 27*d* (see FIG. 5) acts on the ink 19 due to adhesion acting between the ink on the surface of the master 27 and the sheet 18.

Figure 5:
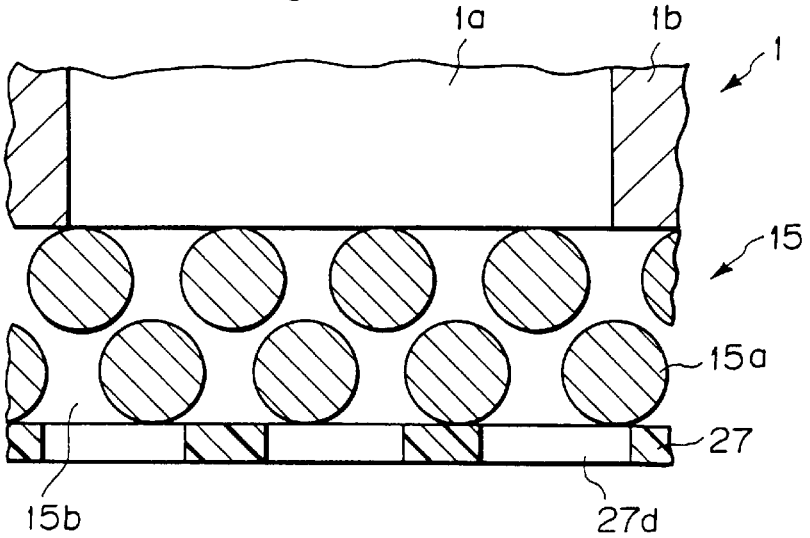
FIG. 5 is a view similar to FIG. 4, showing how ink is transferred to a sheet in the first embodiment.
Figure 5:
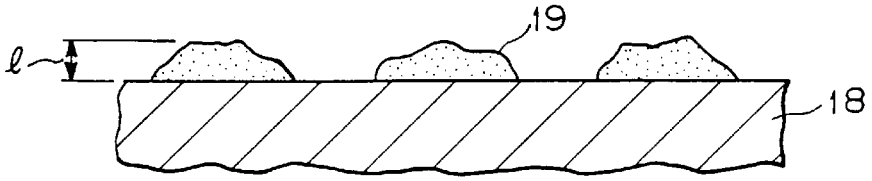

The ink holding member 15 is a sintered sheet of high-density unwoven cloth constituted by metal fibers, as stated previously. Therefore, the gaps between the fibers, i.e., the ink passages are narrow, limiting the fluidity of the ink. Consequently, as shown in FIG. 5, the ink in the ink holding member 15 cuts sharply. This reduces the amount of the ink 19 to be drawn out of the member 15 via the perforations 27*d* of the master 27, i.e., the height l of the ink transferred to the sheet 18. Moreover, because many metal fibers 15*a* of the member 15 exist above the perforations 27*d*, there can be reduced the size of the ink passages and therefore the outflow of the ink.

Because the ink holding member 15 is a metallic member, it has a high energy, highly wettable surface. This enhances adhesion acting between the member 15 and the ink and thereby allows the ink in the member 15 to cut sharply. Consequently, the ink is prevented from being drawn out from the member 15 in an excessive amount and bringing about offset.

Should the density of the ink holding member 15 be low, gaps or bores 15*b* between the metal fibers 15*a* would increase in size and aggravate offset. Conversely, should the density be excessively high, the gaps 15*b* would decrease in size and obstruct, at the portions where many fibers intersect, the flow of the ink, resulting in the local omission of an image (fiber marks). A series of experiments were conducted in order to determine a relation between the density of the member 15 and the offset.

The experiments showed that when the metal fibers of the ink holding member 15 are formed of stainless steel or iron, the density should preferably be between 0.7 g/cm$^3$ and 3.0 g/cm$^3$, more preferably between 0.9 g/cm$^3$ and 3.0 g/cm$^3$. The experiments also showed that the density should preferably be between 0.4 g/cm$^3$ and 1.7 g/cm$^3$, more preferably between 0.5 g/cm$^3$ and 1.7 g/cm$^3$, when the metal fibers are formed of titanium, or between 0.2 g/cm$^3$ and 1.0 g/cm$^3$, more preferably between 0.3 g/cm$^3$ and 1.0 g/cm$^3$, when they are formed of aluminum. It follows that the member 15 has a preferable density range Dw and a more preferable density range Dw1 expressed as:

$$Dw=0.09\rho\sim0.38\rho\ (\mathrm{g/cm^3})$$

$$Dw1=0.11\rho\sim0.38\rho\ (\mathrm{g/cm^3})$$

where ρ is the density of a substance (g/cm$^3$).

The above two equations are also true with a second and a fifth embodiment and a modification thereof which will be described. Further, the two equations are also applicable to, in a third or a fourth embodiment, at least the density of the outermost layer of an ink holding member 34 or 35 around which the master 27 is to be wrapped.

The ink holding member 15 is more elastic than a member constituted by natural fibers or synthetic resin. Therefore, when a press roller or similar pressing member is pressed against the member 15 in order to squeeze the ink out of the member 15 and then released from the member 15, the member 15 restores its original position while sucking the ink thereinto. This also prevents the ink from being transferred to the sheet 18 in an excessive amount and thereby insures desirable printings free from offset.

Furthermore, the ink holding member 15 is stronger than a member constituted by natural fibers or synthetic resin. Therefore, the member 15 yields little even when used over a long period of time. This kind of member 15 is highly durable and suitable for mass printing.

In the sintered sheet of unwoven cloth, the fibers are arranged irregularly and effectively obviate a moire pattern ascribable to the interference between the pores 1*a* and the perforations 27*d* arranged regularly in the porous support 1*b* and master 27, respectively. Further, the irregular arrangement of the fibers promote the scattering of the ink and thereby guarantees images, including solid images, having uniform density. In addition, because the metal fibers are connected together at their intersecting points by heat treatment, the sintered sheet is higher in tensile strength and durability than unwoven cloth not subjected to such heat treatment.

Figure 6:
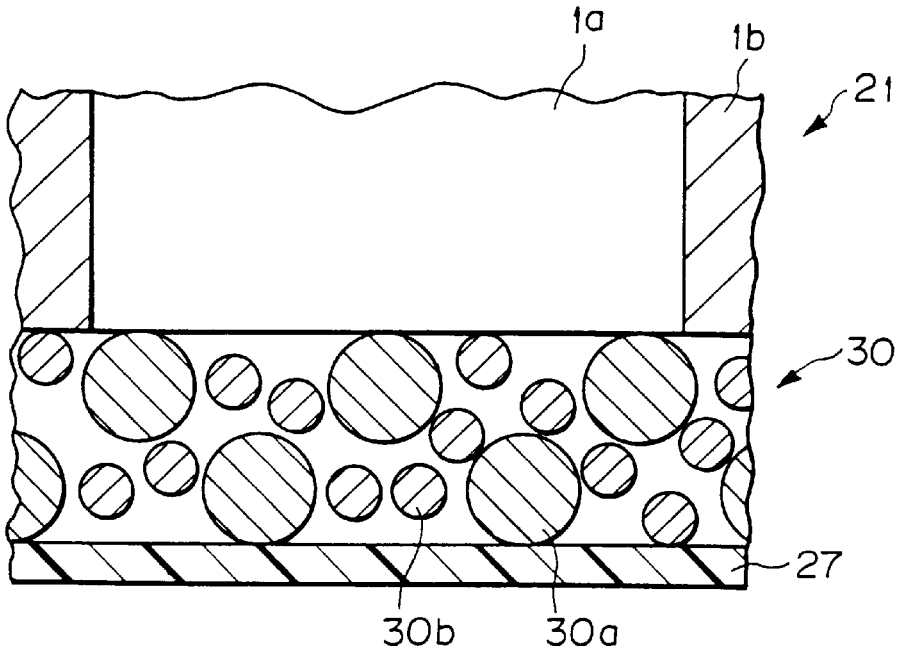
FIG. 6 is a fragmentary sectional side elevation showing a drum and an ink holding member representative of a second embodiment of the present invention.

FIG. 6 shows a drum 21 representative of a second embodiment of the present invention. As shown, the drum 21 is mainly constituted by the porous support 1*b* and an ink holding member 30. The rest of the construction is the same as in the first embodiment. The ink holding member 30 is a sintered sheet of unwoven cloth in which metal fibers 30*a* and metal fibers 30*b* each having a particular diameter are arranged. Of course, three or more different kinds of metal fibers may be arranged in the unwoven cloth.

In this ink holding member 30, the fibers 30*b* smaller in diameter than the fibers 30*a* fill the gaps between the fibers 30*a*. This kind of member 30 increases tensile strength and reduces the size of the gaps or bores, compared to a member consisting only of the fine fibers 30*b*.

Figure 7:
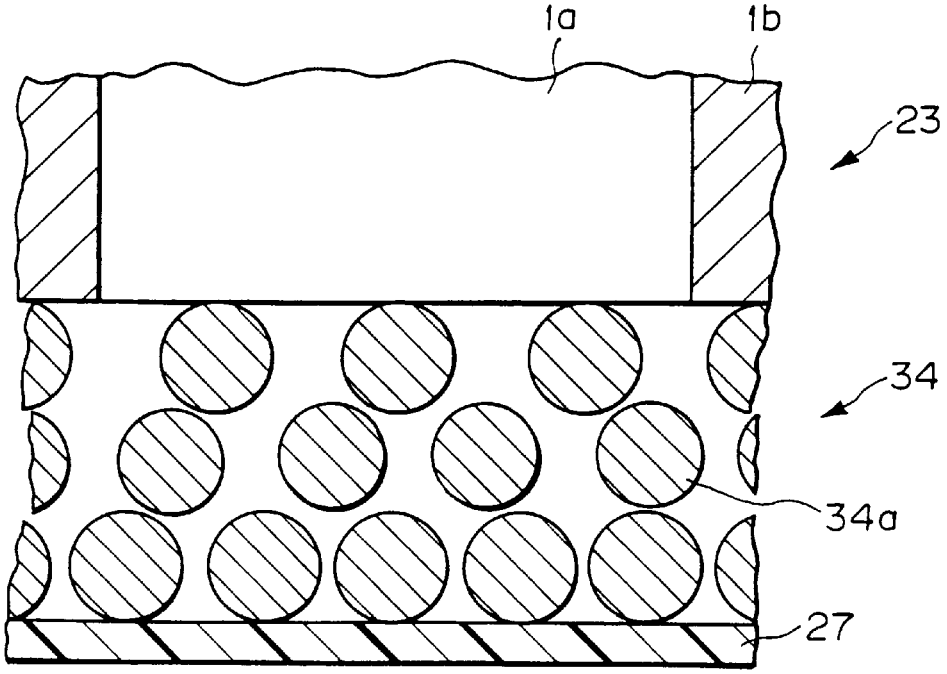
FIG. 7 is a fragmentary sectional side elevation showing a drum and an ink holding member representative of a third embodiment of the present invention.
Figure 8:
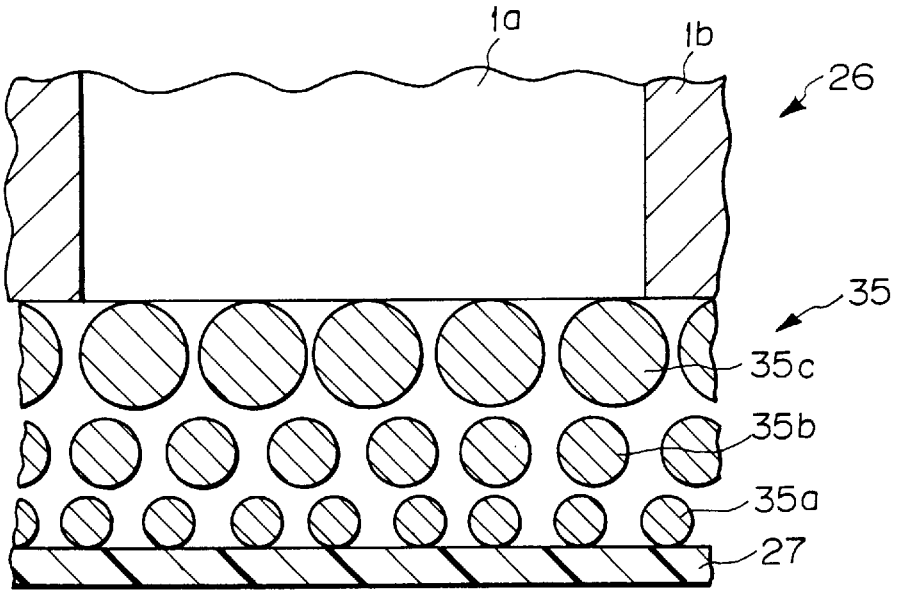
FIG. 8 is a fragmentary sectional side elevation showing a drum and an ink holding member representative of a fourth embodiment of the present invention.

FIGS. 7 and 8 respectively show a drum 23 and a drum 26 representative of a third and a fourth embodiment of the present invention. As for the rest of the construction, the third and fourth embodiments are each identical with the first embodiment. As shown in FIG. 7, the drum 23 is mainly constituted by the porous support 1*b* and an ink holding member 34. The ink holding member 34 is a sintered sheet of unwoven cloth in which metal fibers 34*a* identical in diameter are arranged in a plurality of layers. However, the density of the metal fibers 34*a* sequentially decreases from the layer adjoining the master 27 consisting only of a thermoplastic resin film toward the layer adjoining the porous support 1*b*.

As shown in FIG. 8, the drum 26 is mainly constituted by the porous support 1*b* and an ink holding member 35. The ink holding member 35 is a sintered sheet of unwoven cloth in which metal fibers 35*a*, 35*b* and 35*c* different in diameter are arranged in layers. The fibers 35*a* adjoining the master 27 have the smallest diameter while the fibers 35*c* adjoining the porous support 1*b* have the greatest diameter.

In each of the above drums 23 and 26, the gap between the adjacent fibers of the ink holding member 34 or 35 sequentially decreases from the layer not adjoining the master 27 to the layer adjoining the master 27.

While the members 34 and 35 are shown as having three layers each, they may, of course, be provided with two or more layers each, as desired. The layers of the metal fibers 34*a* or those of the metal fibers 35*a*–35*c* may be implemented as an integral structure or a laminate structure, as desired. For the laminate structure, a plurality of ink holding members each having bores of particular size may be sequentially laminated such that the gaps sequentially decrease in size toward the outer periphery of the drum. In any case, in the member 34 or 35, the first fiber layer with respect to the direction of the ink passages has great bores and promotes the feed and scattering of the ink, while the last layer has bores small enough for the ink to cut sharply.

Figure 9:
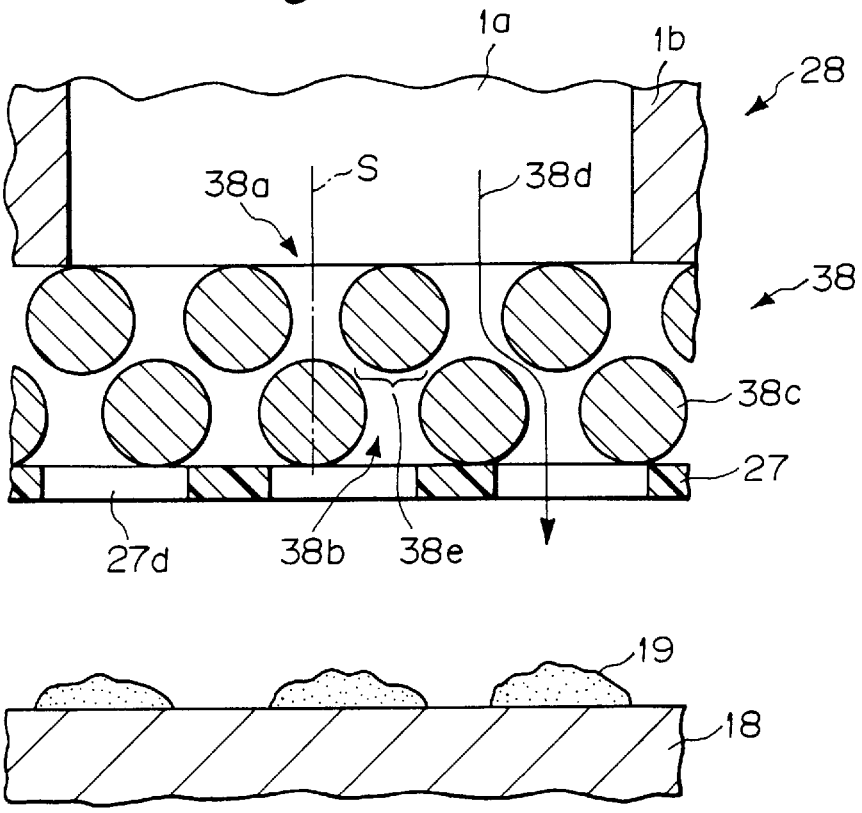
FIG. 9 is a fragmentary sectional side elevation showing a drum and an ink holding member representative of a fifth embodiment of the present invention.

Referring to FIG. 9, a drum 28 representative of a fifth embodiment of the present invention will be described. The rest of the construction is the same as in the first embodiment. As shown, the drum 28 is mainly constituted by the porous support 1*b* and an ink holding member 38. The ink holding member 38 is a sintered sheet of unwoven cloth of metal fibers 38*c*. The member 38 is formed with ink inlet openings 38*a*, ink outlet openings 38*b*, and ink passages 38*d*. Assume a line S perpendicular to the outer periphery of the drum 28 where the outlet openings 38*b* are present. Then, the passages 38*d* are each configured such that the ink 19 entered any one of the inlet openings 38*a* is shifted from the line S at least once, and then flows out downward via the outlet openings 38*b*.

More specifically, each ink passage 38*d* is configured such that the ink 19 entered the inlet opening 38*a* is substantially entirely blocked by one of the metal fibers 38*c* present on the above line S and prevented from flowing down along the line S. Stated another way, the ink 19 substantially entirely blocked by the metal fiber 38*c* is caused to flow sideways away from the line S and then flow down toward the outlet openings 38*b*.

When the sheet 18 is separated from the surface of the master 27, adhesion acts between the ink 19 and a ceiling portion 38*e* above the outlet opening 38*b*. This successfully reduces the amount of the ink 19 to be drawn out of the ink holding member 38.

Figure 10:
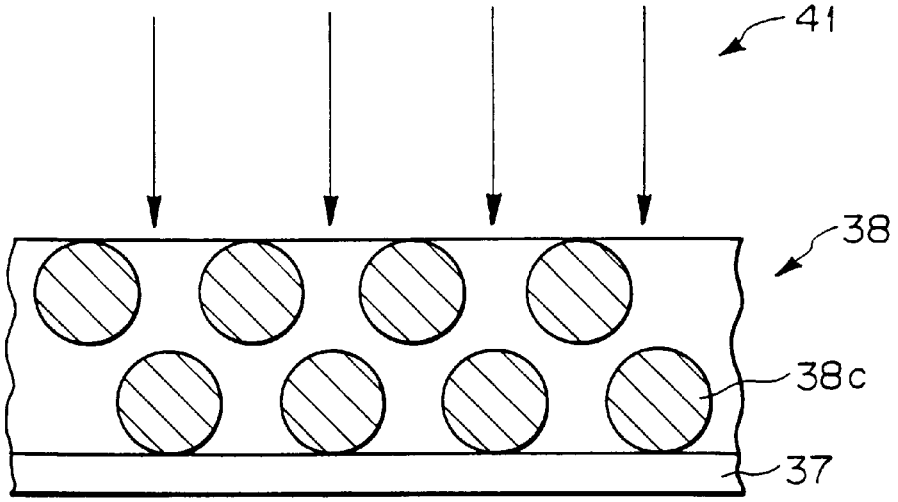
FIGS. 10 and 11 each shows a specific method for examining the configuration of the ink holding member included in the fifth embodiment.

Specific methods for determining whether or not the ink passages 38*d* having the above unique configuration have been formed in the ink holding member 38 will be described. FIG. 10 shows a first method using a sheet 37 different in color from the member 38 and adhered to the rear of the member 38. In this case, while light 41 is incident to the member 38, the member 38 is observed by a ×50 microscope. If the sheet 37 is not visible through the gaps between the metal fibers 38*c*, it can be determined that the passages 38*d* have been successfully formed.

Figure 11:
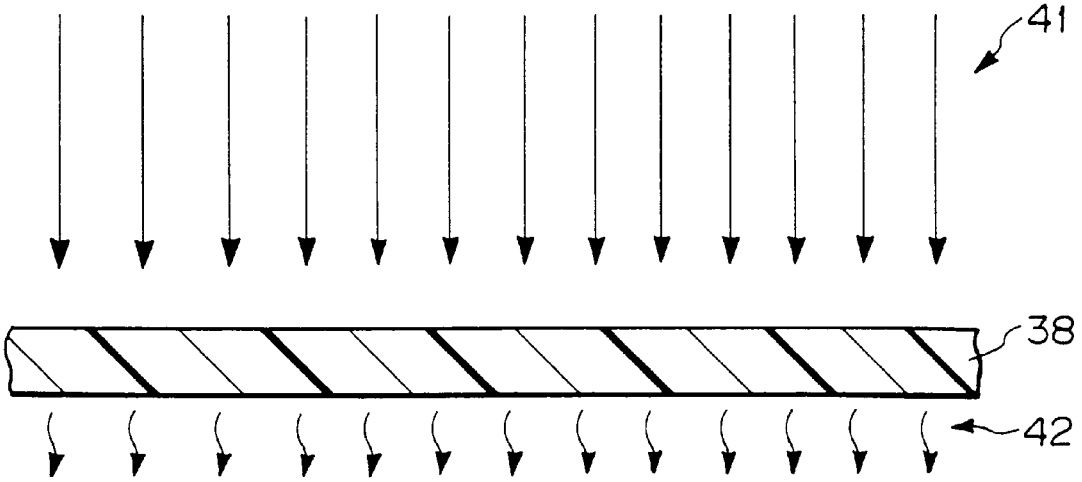

FIG. 11 shows a second method not using the sheet 37 shown in FIG. 10. As shown, parallel light 41 is incident to one surface of the ink holding member 38 perpendicularly thereto. In this case, light 42 reaching the other surface of the member 38 is measured by an actinometer (e.g. laser type sensor LX2-100 available from Keyence Corp.). Because the parallel light 41 is reflected by the walls of the passages 38*d*, it does not reach the other surface of the member 38. Therefore, if the light 42 is not measured by the actinometer, it can be determined that the passages 38*d* have been successfully formed.

Figure 12:
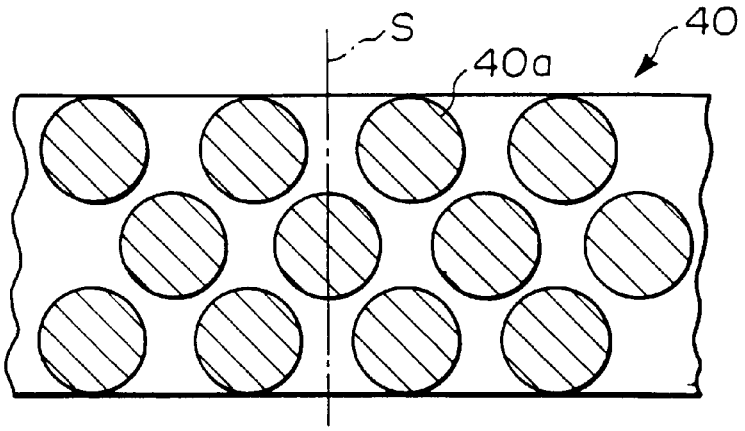
FIG. 12 is a fragmentary sectional side elevation showing a modification of the fifth embodiment.

FIG. 12 shows a modification of the fifth embodiment. As shown, metal fibers 40*a* similar to the metal fibers 38*c* are arranged in an ink holding member 40 in three or more consecutive layers.

In the fifth embodiment or its modification, the metal fibers 38*c* or 40*a* may be replaced with metal fibers of two or more different diameters. Also, as in the third or fourth embodiment, the density or the diameter of the metal fibers 38*c* or 40*a* constituting the ink holding member 38 or 40 may be so varied as to sequentially decrease the size of the bores toward the outer periphery of the drum.

Figure 13:
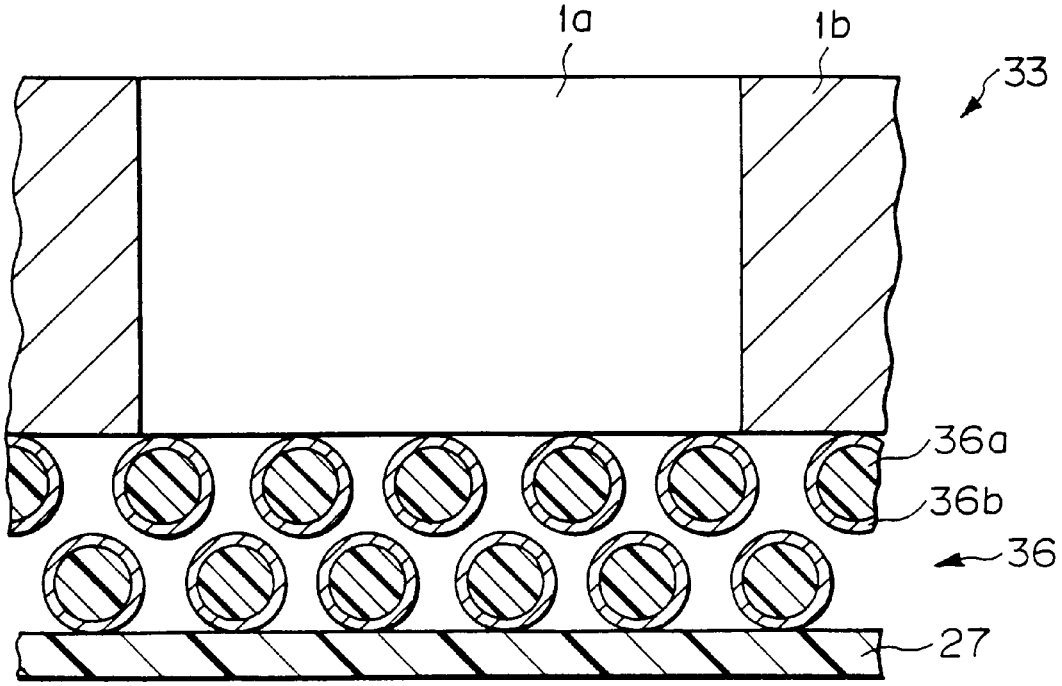
FIG. 13 is a view similar to FIG. 12, showing a modification of any one of the first to fifth embodiments.

FIG. 13 shows a modification of the first embodiment. As shown, a drum 33 is made up of the porous support 1*b* having the pores 1*a*, and an ink holding member 36. The ink holding member 36 is a sintered sheet formed by coating the surfaces of TETRON, nylon or similar synthetic resin fibers 36*a* with metal 36*b*, e.g., stainless steel, iron, copper, nickel, titanium or aluminum. This modification may also be applied to any one of the second to fifth embodiments. In any one of such modifications, while the preferable range Dw and more preferable range Dw1 stated earlier also hold, the density ρ of a substance corresponds to the density of the fibers coated with metal.

In the first to fifth embodiments and their modifications, the drum consists of the porous support 1*b* and ink holding member. If desired, the support 1*b* may be omitted, as taught in, e.g., Japanese Patent Laid-Open Publication No. 1-204781 or 59-218889. In this case, the drum will be provided only with a hollow cylindrical ink holding member; a sheet will be referred to as an ink holding member, as distinguished from a hollow cylinder disposed in the printer.

Further, in any one of the first to fifth embodiments and their modifications, a mesh screen, unwoven cloth or similar ink holding layer may be interposed between the porous support 1*b* of the drum and the ink holding member.

It is to be noted that the stencil consisting only of a thermoplastic resin film and used in the embodiments refers not only to one consisting only of a thermoplastic resin film, but also to one whose thermoplastic resin film contains a small amount of, e.g., antistatic agent, and one having a single or a plurality of thin overcoat layers formed on the front and/or the rear of the film.

As for the stencil, there may be used a laminate structure comprising the thermoplastic resin film and the porous substrate formed of the following alternative materials: porous thin sheet of kozo, mitsumata, Manila hemp, flax or similar natural fibers; mesh screen or unwoven cloth constituted by rayon, Vinylon, fluorine-contained resin, polyester or similar synthetic fibers; mesh screen in which fibers of stainless steel, iron, copper, nickel, aluminum, titanium or similar metal intersect in a mesh configuration; sintered sheet formed by sintering synthetic fibers; porous elastic member based on polyvinyl acetal or polyvinyl alcohol and having continuous cells; porous elastic member implemented by a mixture of hard grain and rubber and having continuous cells; porous elastic member produced by sintering fine powder of polyethylene or similar synthetic resin or inorganic substance; porous elastic member formed by liquid sintering of, e.g., polyurethane; and porous elastic member formed of, e.g., porous rubber.

The amount of the ink existing between the surface of the thermoplastic resin film and the ink holding member (15, 30, 34, 35, 36, 38, 40) which limits the outflow of the ink (i.e. existing in the porous substrate) decreases with a decrease in the thickness of the porous substrate. Consequently, the amount of the ink present above the perforations of the master, i.e., the amount of the ink to be drawn out from the porous substrate decreases with a decrease in the thickness of the substrate. Therefore, the porous substrate is not desirable in the offset aspect. However, the porous substrate is desirable when it comes to the durability of the master. It follows that the thickness of the master should preferably be 10 μm to 30 μm in consideration of offset.

Figure 14:
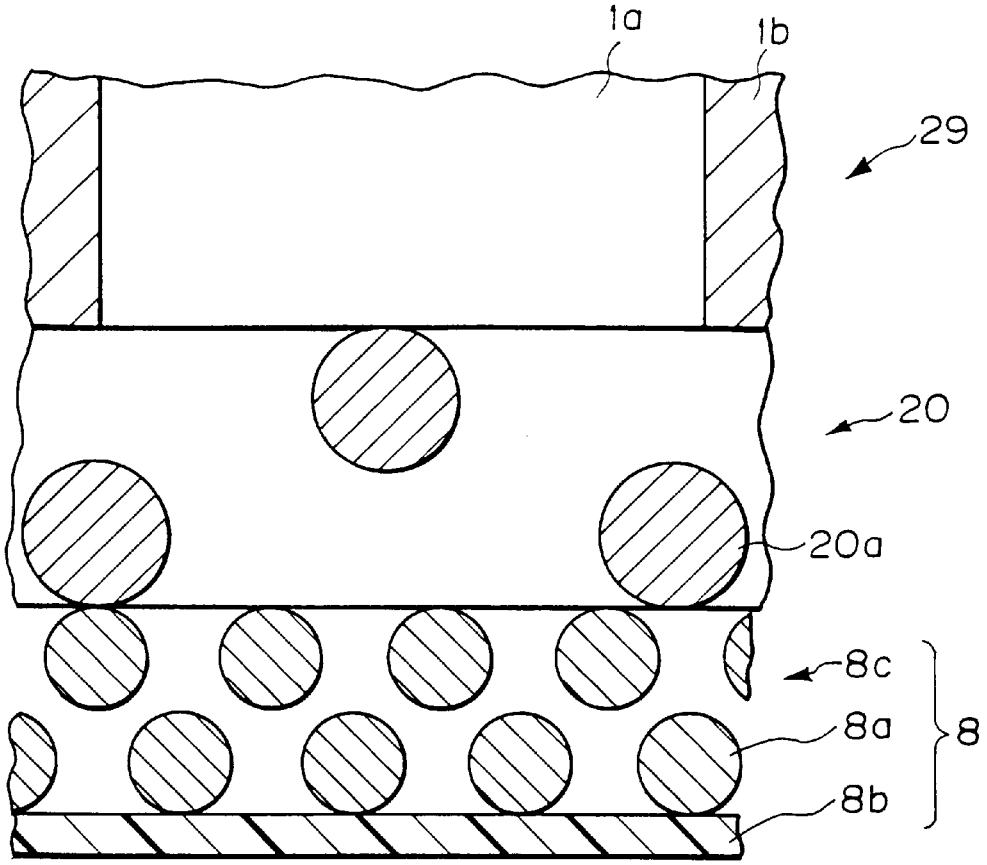
FIG. 14 is a fragmentary sectional side elevation showing a drum and a stencil representative of a sixth embodiment of the present invention.

FIG. 14 shows a drum 29 and a stencil or master 8 representative of a sixth embodiment of the present invention. The rest of the construction is the same as in the first embodiment. As shown, the drum 29 has the porous support 1*b* formed with the pores 1*a*, and an ink holding layer 20 covering the support 1*b*. The ink holding layer 20 is implemented by a mesh screen in which fibers 20*a* formed of, e.g., TETRON, nylon or similar synthetic resin or stainless steel intersect each other. The fibers 20*a* form ink passages for scattering and holding the ink therein. If desired, the drum 29 may be provided with two or more ink holding layers or may not be provided with any such layer.

In the illustrative embodiment, the master 8 is made up of a porous substrate 8*c* and a thermoplastic resin film 8*b* adhered or otherwise connected together. The substrate 8*c* is a sintered sheet of high-density unwoven cloth of fibers 8*a* formed of stainless steel, iron, copper, nickel, titanium, aluminum or similar metal. For the film 8*b*, use may be made of polyester by way of example. If desired, fine powder of, e.g., metal may be dispersed in the substrate 8*c* and then deposited or adhered in order to reduce the size of the bores between the fibers 8*a*.

The substrate 8*c* should preferably have high density. For example, when the substrate 8*c* is implemented by fibers of stainless steel or iron, the density should preferably be between 0.7 g/cm$^3$ and 3.0 g/cm$^3$, more preferably between 0.9 g/cm$^3$ and 3.0 g/cm$^3$, as in the first embodiment. Also, the density should preferably be between 0.4 g/cm$^3$ and 1.7 g/cm$^3$, more preferably between 0.5 g/cm$^3$ and 1.7 g/cm$^3$, when the substrate 8*c* is implemented by fibers of titanium, or between 0.2 g/cm$^3$ and 1.0 g/cm$^3$, more preferably between 0.3 g/cm$^3$ and 1.0 g/cm$^3$, when it is implemented by fibers of aluminum.

The substrate 8*c* has, as in the first embodiment, a preferable density range Dw and a more preferable density range Dw1 expressed as:

$$Dw=0.09\rho\sim0.38\rho\ (\mathrm{g/cm^3})$$

$$Dw1=0.11\rho\sim0.38\rho\ (\mathrm{g/cm^3})$$

where ρ is the density of a substance (g/cm$^3$).

The above two equations are also true with a seventh and a tenth embodiment and a modification thereof which will be described. Further, the two equations are also applicable to, in an eighth or a ninth embodiment, at least the density of the outermost layer of a porous substrate 24*b* or 25*d* contacting the thermoplastic resin film 8*b*.

In the above embodiment, the porous substrate 8*c* intervenes between the master or thermoplastic resin film 27 and the ink holding member 15 of the first embodiment. This is why the substrate 8*c* is constituted by a sintered sheet of metal fibers 8*a*.

As stated above, because the porous substrate 8*c* is a sintered sheet of high-density metal fibers 8*a*, bores or ink passages formed in the substrate 8*c* are narrow enough to allow the ink to cut sharply. This limits the amount of the ink to be drawn out from the master 8. Because the substrate 8*c* has a high energy, highly wettable surface, adhesion acting between the substrate 8*c* and the ink is enhanced and allows the ink in the substrate 8*c* to cut sharply. Consequently, the ink is prevented from being drawn out from the substrate 8*c* in an excessive amount and bringing about offset. In addition, the metal fibers constituting the sintered sheet are joined together by heat at their intersecting points, so that the sheet is superior to a porous substrate not subjected to heat treatment as to tensile strength and oil and water resistance. The sheet is therefore prevented from stretching or breaking during printing and noticeably enhances the resistance of the master to printing.

The substrate 8*c* is more elastic than a porous substrate constituted by natural fibers or synthetic resin. Therefore, when a press roller or similar pressing member is pressed against the substrate 8*c* in order to squeeze the ink out of the substrate 8*c* and then released from the substrate 8*c*, the substrate 8*c* restores its original position while sucking the ink thereinto. This also prevents the ink from being transferred to a sheet in an excessive amount and thereby insures desirable printings free from offset.

Furthermore, the substrate 8*c* is stronger than a porous substrate constituted by natural fibers or synthetic resin. Therefore, the substrate 8*c* yields little even when used over a long period of time. This kind of substrate 8*c* is highly durable and suitable for mass printing.

In the sintered sheet of unwoven cloth, the fibers are arranged irregularly and effectively obviate a moire pattern ascribable to the interference between the pores 1*a* and the perforations arranged regularly in the porous support 1*b* and thermoplastic resin film 8*b*, respectively. Further, the irregular arrangement of the fibers promotes the scattering of the ink and thereby guarantees images, including solid images, having uniform density. In addition, because the metal fibers are connected together at their intersecting points by heat treatment, the sintered sheet is higher in tensile strength and durability than unwoven cloth not subjected to such heat treatment.

Figure 15:
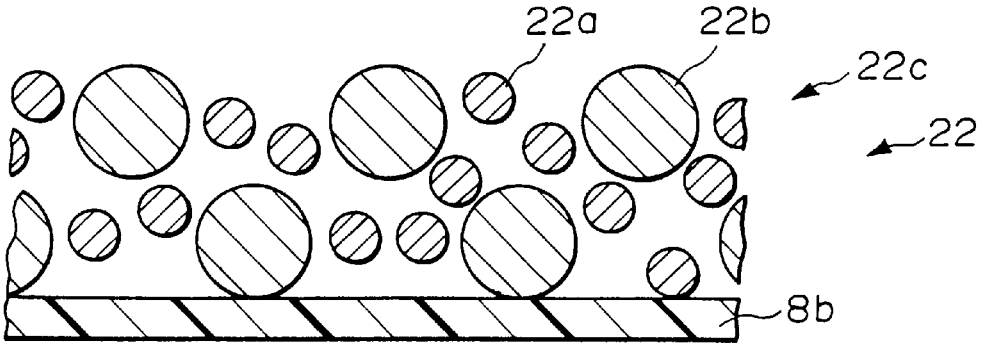
FIG. 15 is a fragmentary sectional side elevation showing a stencil representative of a seventh embodiment of the present invention.

FIG. 15 shows a stencil or master 22 representative of a seventh embodiment of the present invention. As shown, the master 22 is mainly constituted by a porous substrate 22*c* and the thermoplastic resin film 8*b*. The rest of the construction is the same as in the sixth embodiment. The porous substrate 22*c* is a sintered sheet of unwoven cloth in which metal fibers 22*a* and metal fibers 22*b* each having a particular diameter are arranged. Of course, three or more different kinds of metal fibers may be arranged in the unwoven cloth.

In this master 22, the fibers 22*a* smaller in diameter than the fibers 22*b* fill the gaps between the fibers 22*b*. This kind of master 22 increases tensile strength and reduces the bores between the fibers, compared to a member consisting only of the fine fibers 22*a*.

Figure 16:
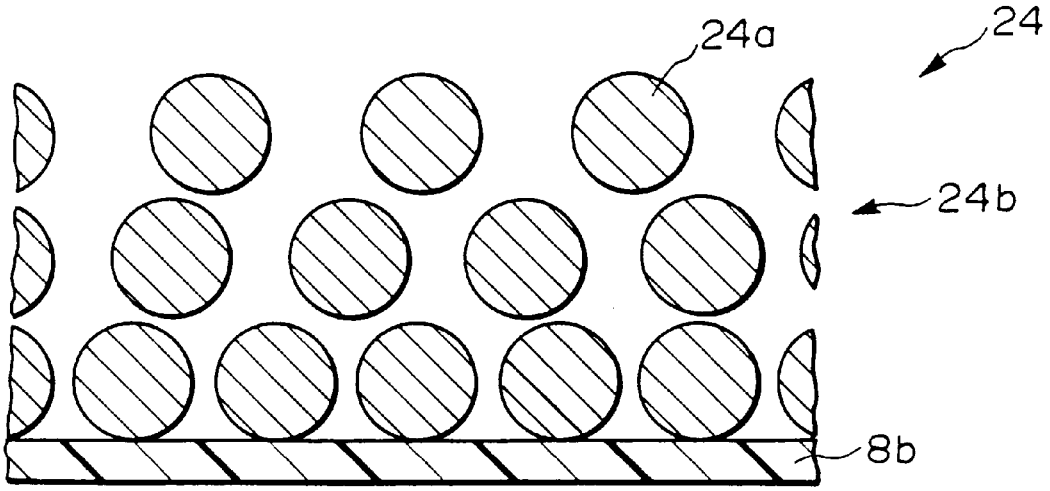
FIG. 16 is a fragmentary sectional side elevation showing a stencil representative of an eight embodiment of the present invention.
Figure 17:
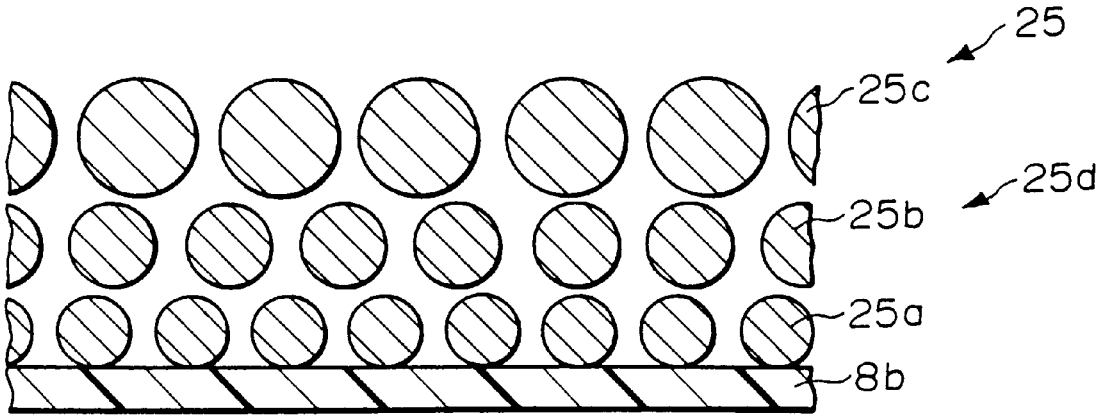
FIGS. 17 and 18 are fragmentary sectional side elevations showing stencils respectively representative of a ninth and a tenth embodiment of the present invention.

FIGS. 16 and 17 respectively show a master 24 and a master 25 representative of an eighth and a ninth embodiment of the present invention. As for the rest of the construction, the eight and ninth embodiments are each identical with the sixth embodiment. As shown in FIG. 16, the master 24 is constituted by a porous substrate 24*b* and the thermoplastic resin film 8*b*. The substrate 24*b* is a sintered sheet of unwoven cloth in which metal fibers 24*a* identical in diameter are arranged in a plurality of layers. However, the density of the metal fibers 24*a* sequentially decreases from the outermost layer adhered to the film 8*b* to the innermost layer.

As shown in FIG. 17, the master 25 is constituted by a porous substrate 25*d* and the thermoplastic resin film 8*b*. The substrate 25*d* is a sintered sheet of unwoven cloth in which metal fibers 25*a*, 25*b* and 25*c* different in diameter are arranged in layers. The fibers 25*a* of the outermost layer adhered to the film 8*b* have the smallest diameter while the fibers 25*c* of the innermost layer have the greatest diameter.

In each of the above porous substrates 24*b* and 25*d*, the bore or gap between the adjacent fibers sequentially decreases from the layer not contacting the film 8*b* to the layer contacting the film 8*b*.

While the substrates 24*b* and 25*d* are shown as having three layers each, they may, of course, be provided with two or more layers, as desired. In any case, in the master 24 or 25, the first fiber layer with respect to the direction of ink passages has great bores between the fibers and promote the feed and scattering of the ink, while the last layer has bores small enough for the ink to cut sharply.

Figure 18:
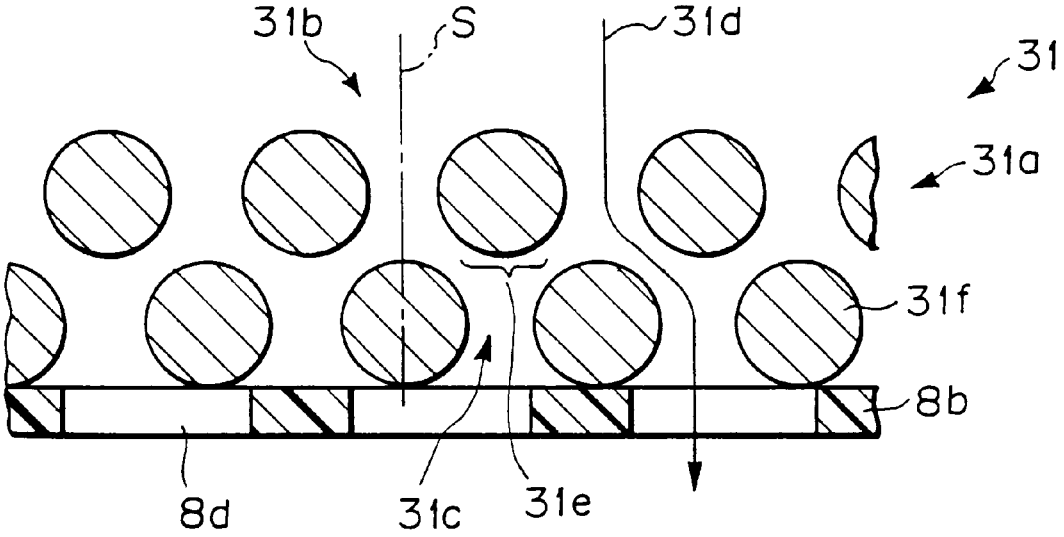

Referring to FIG. 18, a stencil 31 representative of a tenth embodiment of the present invention will be described. The rest of the construction is the same as in the sixth embodiment. As shown, the master 31 has a porous substrate 31*a* which is a sintered sheet of unwoven cloth having metal fibers 31*f*. The substrate 31*a* is formed with ink inlet openings 31*b*, ink outlet openings 31*c*, and ink passages 31*d*. Assume a line S perpendicular to the surface of the film 8*b* contacting the substrate 31*a*. Then, the passages 31*d* are each configured such that the ink entered any one of the inlet openings 31*b* is shifted from the line S at least once, and then flows out via the outlet openings 31*c*.

More specifically, each ink passage 31*d* is configured such that the ink entered the inlet opening 31*b* is substantially entirely blocked by one of the metal fibers 31*f* present on the above line S and prevented from flowing down along the line S. Stated another way, the ink substantially entirely blocked by the metal fiber 31*f* is caused to flow sideways away from the line S and then flow down toward the outlet openings 31*c*.

When the sheet 18 is separated from the surface of the master 31, adhesion acts between the ink 19 and a ceiling portion 31*e* above the outlet opening 31*c*. This successfully reduces the amount of the ink 19 to be drawn out from the substrate 31*a*. In FIG. 18, the reference numeral 8*d* designates perforations formed in the film 8*b*.

Figure 19:
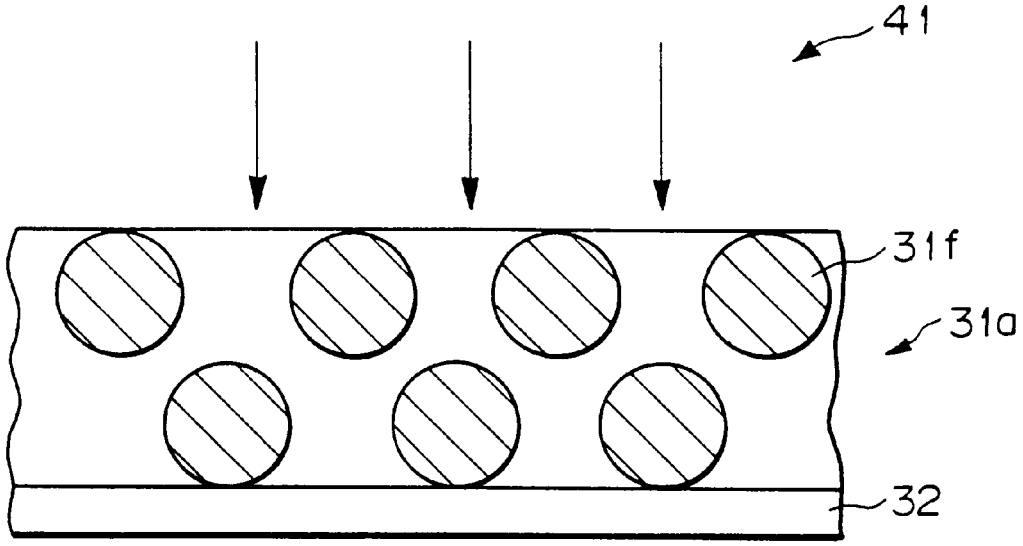
FIGS. 19 and 20 are views for describing the tenth embodiment.

Specific methods for determining whether or not the ink passages 31*d* having the above unique configuration have been formed in the porous substrate 31*a* will be described. FIG. 19 shows a method using a sheet 32 different in color from the substrate 31*a* and adhered to the rear of the substrate 31*a*. In this case, while light 41 is incident to the substrate 31*a*, the substrate 31*a* is observed by a ×50 microscope. If the sheet 32 is not visible through the gaps between the metal fibers 31*f*, it can be determined that the passages 31*d* have been successfully formed. Alternatively, as in the fifth embodiment, parallel light 41 may be incident to one surface of the substrate 31*a* perpendicularly thereto, in which case light reaching the other surface of the substrate 31*a* will be measured by an actinometer.

Figure 20:
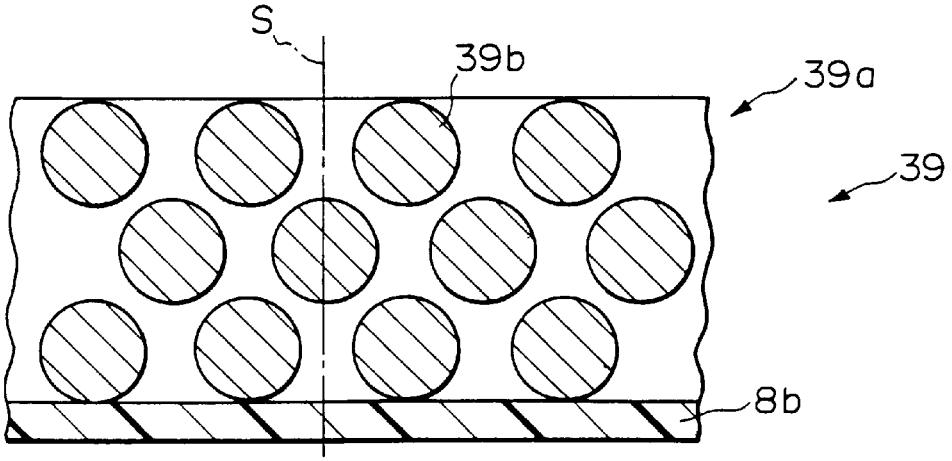

FIG. 20 shows a modification of the tenth embodiment. As shown, a master 39 has a porous substrate 39*a* in which metal fibers 39*b* similar to the metal fibers 31*f* are arranged in three or more consecutive layers.

In the tenth embodiment or its modification, the metal fibers 31*f* or 39*b* may be replaced with metal fibers of two or more different diameters. Also, as in the eighth or ninth embodiment, the density or the diameter of the metal fibers 31*f* or 39*b* constituting the porous substrate 31*a* or 39*a* may be so varied as to sequentially reduce the size of the bores of the substrate toward the side contacting the film 8*b*.

Figure 21:
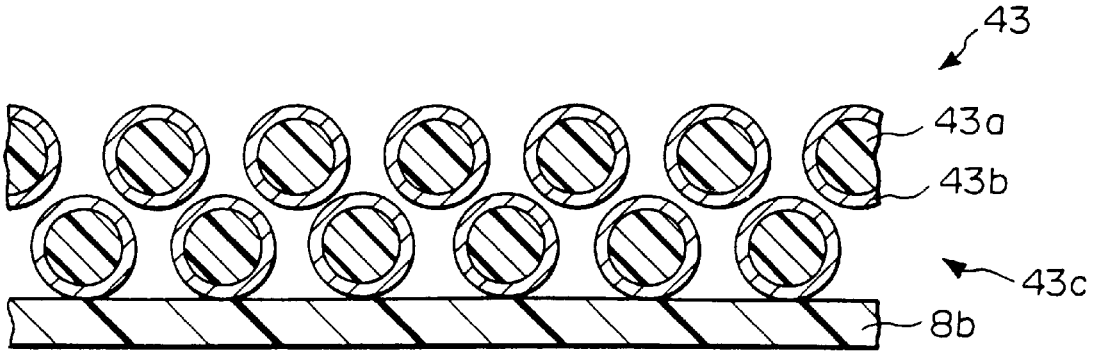
FIG. 21 is a fragmentary sectional side elevation showing a modification of any one of the sixth to tenth embodiments.

FIG. 21 shows a modification of the sixth embodiment. As shown, a master 43 is made up of a porous substrate 43*c* and the thermoplastic resin film 8*b* adhered to each other. The substrate 43*c* is a sintered sheet formed by coating the surfaces of TETRON, nylon or similar synthetic resin fibers 43*a* with metal 43*b*, e.g., stainless steel, iron, copper, nickel, titanium or aluminum. This modification may also be applied to any one of the seventh to tenth embodiments. In any one of such modifications, while the preferable range Dw and more preferable range Dw1 stated earlier also hold, the density ρ of a substance corresponds to the density of the fibers coated with metal.

In summary, it will be seen that the present invention provides a stencil printer and a stencil therefor which have various unprecedented advantages, as enumerated below.

(1) A porous substrate is implemented by a sintered sheet of unwoven cloth of metal fibers. Therefore, bores formed in the substrate are narrow enough to lower the fluidity of ink. Consequently, the ink in the substrate cuts sharply with the result that the amount of the ink to be drawn out from the substrate decreases. Moreover, because many metal fibers of the substrate exist above perforations formed in a thermoplastic resin film, there can be reduced, in effect, the size of the perforations and therefore the outflow of the ink. This successfully obviates offset during printing and insures attractive images.

(2) Use is made of a stencil including a porous substrate in the form of a sintered sheet of metal fibers, so that the substrate has a high energy, highly wettable surface. This enhances adhesion acting between the ink and the substrate and thereby restricts the outflow of the ink. Further, the substrate has high elasticity. Therefore, when a pressing member is pressed against the substrate in order to squeeze the ink and then released from the substrate, the substrate restores its original position while sucking the ink thereinto. This also prevents the ink from being transferred to the sheet in an excessive amount and thereby insures desirable printings free from offset. In addition, because the substrate is strong, it yields little even when used over a long period of time. This, coupled with the fact that the substrate is free from corrosion ascribable to the ink, enhances resistivity to printing and makes the stencil feasible for mass printing.

(3) In the sintered sheet of unwoven cloth, the fibers are arranged irregularly and effectively obviate a moire pattern ascribable to interference between pores and perforations arranged regularly in a porous support and the thermoplastic resin film, respectively. Further, the irregular arrangement of the fibers guarantees images, including solid images, having uniform density. In addition, because the metal fibers are connected together by heat treatment, the sintered sheet has high tensile strength. This, coupled with the fact that the sintered sheet is lower in cost than a mesh screen, increase the strength while reducing the cost.

(4) The porous substrate is constituted by fibers of two or more different diameters. The fibers of smaller diameter fill the gaps between the fibers of greater diameter, reducing the size of the bores of the substrate. Therefore, the ink is drawn out from the substrate in an adequate amount via the perforations of the thermoplastic resin film. This reduces the period of time necessary for the ink to infiltrate and dry and thereby obviates offset. Further, the fibers of greater diameter enhance the strength of the stencil and prevent the stencil from stretching or breaking.

(5) In the porous substrate of the stencil, the bores sequentially decrease in size from the side not contacting the film toward the side contacting it. In this configuration, the ink is smoothly fed and scattered at the inlets of ink passages and then regulated in amount at the outlets of the same. This also reduces the period of time necessary for the ink to infiltrate and dry and thereby obviates offset. In addition, because the substrate plays the role of an ink holding layer customarily wrapped around the drum, desirable images are achievable without resorting to the ink holding layer. This also reduces the cost.

(6) Assume a line S perpendicular to the surface of the thermoplastic resin film. Then, the ink passages are each configured such that the ink entered any one of the inlets is shifted from the line S at least once, and then flows out downward via the outlets. As a result, the amount of the ink to be drawn out from the substrate via the perforations of the film is reduced, so that the ink transferred to the sheet can infiltrate and dry rapidly and offset can be obviated.

(7) The porous substrate has a density range of from 0.09ρ to 0.38ρ, more preferably from 0.11ρ to 0.38ρ where ρ is the density of a substance, so that bores of adequate size are formed between the metal fibers. This allows the ink to be drawn out from the substrate in an adequate amount via the perforations of the film and thereby obviates offset and local omission of an image.

(8) The outermost layer of the porous substrate contacting the thermoplastic resin film has a density range of from 0.09ρ to 0.38ρ, more preferably from 0.11ρ to 0.38ρ, so that bores of adequate size are formed between the metal fibers. This also allows the ink to be drawn out from the substrate in an adequate amount via the perforations of the film and thereby obviates offset and local omission of an image.

(9) An ink holding member of a drum is implemented by a sintered sheet of unwoven cloth of metal fibers. Therefore, bores formed in the ink holding member are narrow enough to lower the fluidity of ink. Consequently, the ink in the ink holding member cuts sharply with the result that the amount of the ink to be drawn out from the member decreases. Moreover, because many metal fibers of the ink holding member exist above perforations formed in a stencil, there can be reduced, in effect, the size of the perforations and therefore the outflow of the ink. Therefore, particularly when use is made of a stencil consisting only of a thermoplastic resin film, offset can be obviated more effectively.

(10) Use is made of the drum including the ink holding member in the form of the sintered sheet of metal fibers, so that the ink holding member has a high energy, highly wettable surface. This enhances adhesion acting between the ink and the holding member and thereby restricts the outflow of the ink. Further, the ink holding member has high elasticity. Therefore, when a pressing member is pressed against the ink holding member in order to squeeze the ink and then released from the member, the member restores its original position while sucking the ink thereinto. This also prevents the ink from being transferred to the sheet in an excessive amount and thereby insures desirable printings free from offset. In addition, because the ink holding member is strong, it yields little even when used over a long period of time. This, coupled with the fact that the ink holding member is free from corrosion ascribable to the ink, enhances resistivity to printing and makes the drum feasible for mass printing.

(11) in the sintered sheet of unwoven cloth, the fibers are arranged irregularly and effectively obviate a moire pattern ascribable to interference between pores and perforations arranged regularly in a porous support and the master, respectively. Further, the irregular arrangement of the fibers guarantees images, including solid images, having uniform density. In addition, because the metal fibers are connected together by heat treatment, the sintered sheet has high tensile strength. This, coupled with the fact that the sintered sheet is lower in cost than a mesh screen, increase the strength while reducing the cost.

(12) The ink holding member is constituted by fibers of two or more different diameters. The fibers of smaller diameter fill the gaps between the fibers of greater diameter, reducing the size of the bores of the ink holding member. Therefore, the ink is drawn out from the ink holding member in an adequate amount via the perforations of the stencil. This reduces the period of time necessary for the ink to infiltrate and dry and thereby obviates offset. Particularly, when the stencil consists only of a thermoplastic resin film, offset is obviated more effectively. Further, the fibers of greater diameter and smaller diameter existing together enhances the durability of the drum without increasing the cost.

(13) In the ink holding member, the bores sequentially decrease in size toward the outer periphery of the drum. In this configuration, the ink is smoothly fed and scattered at the inlets of ink passages and then regulated in amount at the outlets of the same. This also reduces the period of time necessary for the ink to infiltrate and dry and thereby obviates offset. Particularly, when use is made of a stencil consisting only of a thermoplastic resin film, offset can be obviated more effectively.

(14) Assume a line S perpendicular to the outer periphery of the drum. Then, the ink passages are each configured such that the ink entered any one of the inlets is shifted from the line S at least once, and then flows out downward via the outlets. As a result, the amount of the ink to be drawn out from the ink holding member via the perforations of the stencil is reduced, so that the ink transferred to the sheet can infiltrate and dry rapidly and offset can be obviated.

(15) The ink holding member has a density range of from 0.09ρ to 0.38ρ, more preferably from 0.11ρ to 0.38ρ, so that bores of adequate size are formed between the metal fibers. This allows the ink to be drawn out from the ink holding member in an adequate amount via the perforations of the thermoplastic resin film. Particularly, when use is made of a stencil consisting only of a thermoplastic resin film, offset and local omission of an image can be obviated more effectively.

(16) The outermost layer of the ink holding member has a density range of from 0.09ρ to 0.38ρ, more preferably from 0.11ρ to 0.38ρ, so that bores of adequate size are formed between the metal fibers. This also allows the ink to be drawn out from the ink holding member in an adequate amount via the perforations of the film. Particularly, when use is made of a stencil consisting only of a thermoplastic resin film, offset and local omission of an image can be obviated more effectively.

(17) The bores formed in the ink holding member are narrow enough to lower the fluidity of ink. Consequently, the ink in the ink holding member cuts sharply with the result that the amount of the ink to be drawn out from the member decreases. Moreover, because many metal fibers of the ink holding member exist above perforations formed in a stencil, there can be reduced, in effect, the size of the perforations and therefore the outflow of the ink. Particularly, when use is made of a stencil consisting only of a thermoplastic resin film, offset can be obviated more effectively.

(18) The ink holding member having its surface implemented by metal has a high energy, highly wettable surface. This enhances adhesion acting between the ink and the ink holding member and thereby restricts the outflow of the ink. Further, the ink holding member has high elasticity. Therefore, when a pressing member is pressed against the ink holding member in order to squeeze the ink and then released from the member, the member restores its original position while sucking the ink thereinto. This also prevents the ink from being transferred to the sheet in an excessive amount. Particularly, when use is made of a stencil consisting only of a thermoplastic resin film, offset can be obviated more effectively. In addition, because the ink holding member is strong, it yields little even when used over a long period of time. This, coupled with the fact that the ink holding member is free from corrosion ascribable to the ink, enhances resistivity to printing and makes the ink holding member feasible for mass printing.

(19) In the ink holding member, the bores sequentially decrease in size toward the outer surface. In this configuration, the ink is smoothly fed and scattered at the inlets of ink passages and then regulated in amount at the outlets of the same. This also reduces the period of time necessary for the ink to infiltrate and dry. Particularly, when use is made of a stencil consisting only of a thermoplastic resin film, offset can be obviated more effectively.

(20) Assume a line S perpendicular to the surface of the ink holding member formed with the ink outlets. Then, the ink passages are each configured such that the ink entered any one of the inlets is shifted from the line S at least once, and then flows out downward via outlets. As a result, the amount of the ink to be drawn out from the ink holding member via the perforations of the stencil is reduced, so that the ink transferred to the sheet can infiltrate and dry rapidly and offset can be obviated.

Various modifications will become possible for those skilled in the art after receiving the teachings of the present disclosure without departing from the scope thereof.

What is claimed is:

1. An ink holding member on an outer surface of a drum included in a stencil printer, comprising:

a sintered sheet of fibers, wherein at least surfaces of said fibers are constituted by metal, wherein said ink holding member has a density range Dw expressed as:

$$Dw=0.09\rho\sim0.38\rho$$

where ρ denotes a density of a substance (g/cm$^3$).

2. An ink holding member as claimed in claim 1, wherein said fibers are of at least two diameters.

3. An ink holding member as claimed in claim 1, wherein bores formed in said ink holding member sequentially decrease in size from an inner surface toward an outer surface of said ink holding member.

4. An ink holding member as claimed in claim 1, further comprising ink inlet openings, ink outlet openings, and ink passages configured such that ink entered in any one of said ink inlet openings is shifted at least once from a line perpendicular to the outer surface of said drum and then flows out via said ink outlet openings.

5. A drum included in a stencil printer, comprising:

an ink holding member on an outer periphery of said drum, and allowing a master to be wrapped around said ink holding member, said ink holding member comprises a sintered sheet of fibers, wherein at least surfaces of said fibers are constituted by metal, wherein said ink holding member has a density range Dw expressed as:

$$Dw=0.09\rho\sim0.38\rho$$

where ρ denotes a density of a substance (g/cm$^3$).

6. A drum as claimed in claim 5, wherein said fibers are of at least two diameters.

7. A drum as claimed in claim 5, wherein said ink holding member has bores sequentially decreasing in size from an inner surface toward an outer surface of said ink holding member.

8. A drum as claimed in claim 5, wherein said ink holding member comprises ink inlet openings, ink outlet openings, and ink passages configured such that ink entered in any one of said ink inlet openings is shifted at least once from a line perpendicular to an outer surface of said drum and then flows out via said ink outlet openings.

* * * * *